United States Patent [19]

Soerensen

[11] 3,967,576

[45] July 6, 1976

[54] TETRAPODE FOR MARKING OFF PURPOSES

[76] Inventor: Erik Boerge Soerensen, 68 Langelinie, 7100 Vejle, Denmark

[22] Filed: Mar. 13, 1975

[21] Appl. No.: 557,950

[30] Foreign Application Priority Data

Apr. 1, 1974 Denmark ..... 1786/74

[52] U.S. Cl. ..... 116/63 P; 116/63 C

[51] Int. Cl.[2] ..... E01F 9/00; G08B 5/00

[58] Field of Search ..... 116/63 P, 63 T, 63 C, 116/63 R; 40/125 N; 52/719; 350/97

[56] References Cited

UNITED STATES PATENTS

| | | | |
|---|---|---|---|
| 2,333,273 | 11/1943 | Scanlon | 116/63 C |
| 2,483,734 | 10/1949 | Neal | 116/63 T |
| 3,105,457 | 10/1963 | Krueger | 116/63 P |
| 3,200,786 | 8/1965 | Swezy | 40/125 N |
| 3,635,542 | 1/1972 | Parduhn | 350/97 |

*Primary Examiner*—S. Clement Swisher
*Assistant Examiner*—Denis E. Corr
*Attorney, Agent, or Firm*—Burgess Ryan and Wayne

[57] ABSTRACT

A portable traffic marker in the form of a tetrapod with one by hollow is disclosed. A counter sink may be formed in each of the other three legs shaped as a parabola. A plurality of this type of marker may be nested together by means of the hollow and countersink.

2 Claims, 4 Drawing Figures

TETRAPODE FOR MARKING OFF PURPOSES

The invention relates to a tetrapode for road marking purposes - particularly for alerting drivers in connection with road repairs.

Known forms of road markers and warning indicators for road repairs, e.g. truncated cones offer good protection for drivers and for the persons occupied with road repairs, as the truncated cone indicates that the road conditions are not normal.

The use of truncated cones for this purpose still has the undesirable feature, that they are easily overturned by accidental causes as e.g. wind pressure from the suction following passing motor vehicles. In the overturned state the truncated cone does not offer the same degree of road safety, as the road user must get closer to the road marker to perceive the same.

To avoid these drawbacks and the increased potential danger, which may arise in connection with overturned truncated cones, one may instead of truncated cones use tetrapodes, which according to their geometrical nature will always have one of its legs pointing away from the road surface at right angles thereto. The tetrapode will, therefore, always offer maximum warning indication, as the warning effect is not influencable by incidental factors as e.g. gusts of wind. Tetrapodes are, therefore, used around the world for road marking purposes. The undesirable result of using tetrapodes is that they take much space up during transportation to the place of work and during storage.

The tetrapode according to the invention makes it possible, that two or more tetrapodes according to the invention can be put together, as a leg from a tetrapode can be introduced into a matching leg of another tetrapode, so that put together tetrapodes, according to the invention take up essentially less place than a corresponding number of tetrapodes which are stored individually.

In the drawing is shown a tetrapode according to the invention and

A simple embodiment of the tetrapode according to the invention is obtained when the tetrapode, which is manufactured as a hollow body, is provided with an orifice 1, the centre of which is situated in the point in which three of the legs of the tetrapode meet and converge with the elongated center line of the fourth leg. This orifice 1, the diameter of which is equal to or larger than the largest diameter of a leg of a tetrapode, gives access to the interior of the tetrapode and makes it possible, for a leg from a matching tetrapode to be introduced into the tetrapode and remain in the tetrapode leg, the elongated center line of which is the center of the orifice 1.

Figure 3:
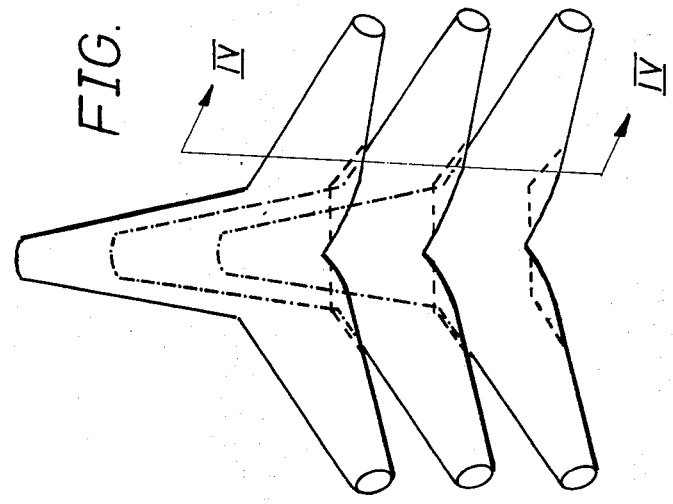
FIG. 3 shows assembled tetrapodes and FIG. 4 the section IV—IV in FIG. 3 of the drawing.
Figure 4:
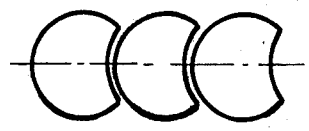
Figure 1:
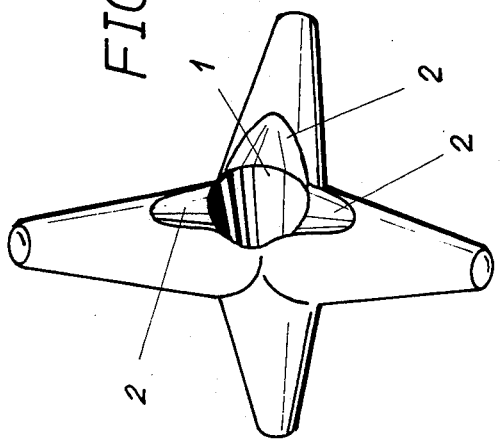
FIG. 1 is the tetrapode in perspective view
Figure 2:
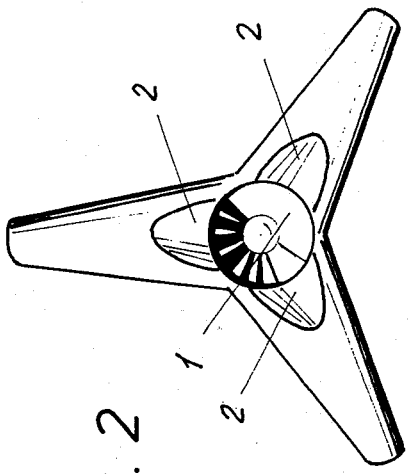
FIG. 2 is the tetrapode as seen from a point on the elongated center line of the fourth leg of the tetrapode.

Another embodiment of the tetrapode according to the invention makes a still better utilization of space during transportation or storage possible, when the tetrapode according to the invention is provided with an orifice 1 and further, on each of the three legs of the tetrapode, where the orifice 1 is and in connection with this orifice 1 a countersinking 2 is provided limited as a parabola and spatially corresponding to the diametrically opposite side of the leg. These countersinkings 2 are a feature that enables assembled tetrapodes, according to the invention to take up still less space, because the three legs which are provided with countersinkings 2 each contact three corresponding legs of another tetrapode. The stacking height will consequently become smaller as shown in FIG. 4 of the drawing. Furthermore the center lines of these countersinkings 2 in the three free legs of stacked tetrapodes make the same angle with the fourth leg. Several adjacent standing stacks of tetrapodes according to the invention will, therefore, take up less space than stacked tetrapodes when the legs do not make the same angle with the horizontal.

In the shown embodiments the orifice 1 and the countersinkings 2 are only shown located at a single place of the tetrapode, but the tetrapode may according to the invention, be provided with an orifice 1 and countersinkings 2 at all the geometrical places of the tetrapode, at which the common point of three legs converge with the elongated center line of the fourth leg. This embodiment makes it possible that tetrapodes according to the invention can be put together in stacks without having first to orient the tetrapodes uniformly.

Futhermore the tetrapode according to the invention can be provided with a funnel shaped aperture pointing into the leg of the tetrapode, the elongated center line of which is the center line of the leg. This funnel, the dimensions of which must correspond to the dimensions of the legs of the tetrapodes, supports penetrating legs in stacked tetrapodes and contributes to guidance and stability.

I claim:

1. A tetrapode for marking-off purposes, comprising four frustoconical legs substantially symmetrically joined to each other at the wider portion of said legs, at least one of said legs being hollowed out sufficiently to receive a portion of a leg of a similarly dimensioned tetrapode, and the other three legs adjoining said one of said legs being provided with generally parabolic depressional interruptions in their frustoconical shapes beginning at points adjoining the hollowed out portion of said of one said legs extending along each of the said other three legs toward the unattached ends thereof, said depressional interruptions being contoured to abut on a major portion of their surfaces, portions of frustoconical legs of a similarly dimensioned tetrapode having a leg inserted into said one of said legs.

2. A tetrapode as recited in claim 1, wherein the hollowed out portion of said one of said legs is contoured to abut a major portion of the surface of said inserted leg of said similarly dimensioned tetrapode.

* * * * *